US011146001B2

(12) United States Patent
Endo et al.

(10) Patent No.: US 11,146,001 B2
(45) Date of Patent: Oct. 12, 2021

(54) PRESS-FIT TERMINAL AND METHOD FOR MANUFACTURING PRESS-FIT TERMINAL

(71) Applicant: DAI-ICHI SEIKO CO., LTD., Kyoto (JP)

(72) Inventors: Takayoshi Endo, Shizuoka (JP); Takuya Takeda, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 85 days.

(21) Appl. No.: 16/606,152

(22) PCT Filed: Apr. 16, 2018

(86) PCT No.: PCT/JP2018/015685
§ 371 (c)(1),
(2) Date: Oct. 17, 2019

(87) PCT Pub. No.: WO2018/225383
PCT Pub. Date: Dec. 13, 2018

(65) Prior Publication Data

US 2021/0151912 A1 May 20, 2021

(30) Foreign Application Priority Data

Jun. 6, 2017 (JP) ..... JP2017-111244

(51) Int. Cl.
*H01R 12/58* (2011.01)
*H01R 13/17* (2006.01)
*H01R 43/16* (2006.01)

(52) U.S. Cl.
CPC ..... *H01R 12/585* (2013.01); *H01R 13/17* (2013.01); *H01R 43/16* (2013.01)

(58) Field of Classification Search
CPC ..... H01R 12/585; H01R 13/517; H01R 43/16
(Continued)

(56) References Cited

U.S. PATENT DOCUMENTS 6,210,181 B1 * 4/2001 Tomita ..... H01R 12/58 439/78
7,955,143 B2 * 6/2011 Zhang ..... H01R 13/17 439/825
(Continued)

FOREIGN PATENT DOCUMENTS

CN 20353846 U 3/2014
DE 20312802 U1 12/2003
(Continued)

OTHER PUBLICATIONS

Notification of First Office Action (CN Application No. 201880028466.9); dated Jun. 18, 2020; 16 pages; Includes English Translation.
(Continued)

*Primary Examiner* — Peter G Leigh
(74) *Attorney, Agent, or Firm* — Howard & Howard Attorneys PLLC

(57) ABSTRACT

A press-fit terminal includes: a cylindrical pin having a narrow portion; and a contact section. The pin has a large diameter portion that has a diameter larger than a diameter of the narrow portion. The contact section includes an elastic contact piece to come into contact with a through hole of a circuit board that is a press-fit attachment object. The contact section is fitted to the narrow portion in a way that enables the contact section to move between a first position and a second position, the first position being a position at which the elastic contact piece does not come into contact with the large diameter portion during attachment to the circuit board, the second position being a position at which the elastic contact piece comes into contact with the large diameter portion during a withdrawal from the circuit board.

8 Claims, 17 Drawing Sheets

(58) Field of Classification Search
USPC ..... 439/751
See application file for complete search history.

(56) References Cited

U.S. PATENT DOCUMENTS

| | | | | |
|---|---|---|---|---|
| 9,350,117 | B2 * | 5/2016 | Zuriarrain Berasategi | H01R 24/38 |
| 9,385,451 | B2 * | 7/2016 | Mukunoki | H01R 13/436 |
| 2008/0144301 | A1 | 6/2008 | Konishi | |
| 2009/0269993 | A1 | 10/2009 | Zhang | |
| 2012/0164893 | A1 | 6/2012 | Mitsuzuka et al. | |
| 2013/0244506 | A1 * | 9/2013 | Endo | H01R 12/585 439/825 |
| 2014/0017914 | A1 * | 1/2014 | Endo | H01R 9/00 439/81 |
| 2015/0079851 | A1 * | 3/2015 | Endo | H01R 13/73 439/736 |
| 2015/0118871 | A1 * | 4/2015 | Yagi | H01R 12/585 439/65 |
| 2017/0310027 | A1 * | 10/2017 | Goto | H01R 12/585 |

FOREIGN PATENT DOCUMENTS

| | | | |
|---|---|---|---|
| JP | H03-014782 | Y | 4/1991 |
| JP | 2000-340285 | A | 12/2000 |
| JP | 2008-153137 | A | 7/2008 |
| JP | 2008-293949 | A | 12/2008 |
| JP | 2010-055868 | A | 3/2010 |
| JP | 4458181 | A | 4/2010 |
| JP | 2016-100320 | A | 5/2016 |
| JP | 2017-084553 | A | 5/2017 |

OTHER PUBLICATIONS

International Search Report and Written Opinion (International Application No. PCT/JP2018/015685); dated Jun. 26, 2018; 9 pages.

Notice of Reasons for Refusal (JP Patent Application No. 2017-111244); dated Feb. 12, 2019; Includes English Translation; 8 pages.

* cited by examiner

PRESS-FIT TERMINAL AND METHOD FOR MANUFACTURING PRESS-FIT TERMINAL

CROSS-REFERENCE TO RELATED APPLICATIONS

This application is a national phase of International Patent Application No. PCT/JP2018/015685, filed Apr. 16, 2018, which claims priority to Japanese Patent Application No. 2017-111244, filed Jun. 6, 2017, the disclosures of which are hereby incorporated by reference in their entirety.

TECHNICAL FIELD

The present disclosure relates to a press-fit terminal and a manufacturing method thereof.

BACKGROUND ART

A press-fit terminal includes a guide pin and a contact section and is, for example, used for a circuit board by inserting the press-fit terminal into a through hole of the circuit board. Patent Literature 1 discloses such a type of press-fit terminals. The contact between the contact section and an electrode in the through hole results in the electronical connection between the press-fit terminal and the through hole.

CITATION LIST

Patent Literature

Patent Literature 1: Japanese Patent No. 4458181

SUMMARY OF INVENTION

Technical Problem

Such a press-fit terminal requires low insertion force during insertion of the press-fit terminal into the through hole and is required to have a high ability to remain connected to the circuit board. However, a tradeoff occurs between the insertion force and the ability to remain connected to the circuit board, and thus the ability to remain connected to the circuit board becomes low with decrease in the insertion force and, conversely, the insertion force becomes high with increase in the ability to remain connected to the circuit board.

The present disclosure is developed in consideration of the aforementioned circumstances, and an objective of the present disclosure is to provide (i) a press-fit terminal enabling achievement of low insertion force with which the press-fit terminal is attached to an attachment portion of a press-fit attachment object without losing an ability to remain connected to the press-fit attachment object and (ii) a method for manufacturing the press-fit terminal.

Solution to Problem

In order to attain the aforementioned objective, a press-fit terminal according to a first aspect of the present disclosure includes: a cylindrical pin having a narrow portion and a large diameter portion that has a diameter larger than a diameter of the narrow portion; and a contact section including an elastic contact piece to come into contact with a press-fit attachment object, the contact section being fitted to the narrow portion in a way that enables the contact section to move between a first position and a second position, the first position being a position at which the elastic contact piece does not come into contact with the large diameter portion during attachment to the press-fit attachment object, the second position being a position at which the elastic contact piece comes into contact with the large diameter portion during a withdrawal from the press-fit attachment object.

The elastic contact piece of the press-fit terminal may be a plurality of elastic contact pieces, and at least one of the plurality of elastic contact pieces may have an engagement portion to engage with the press-fit attachment object.

The pin may have (i) a pin body extending from one of both ends of the narrow portion, (ii) an end portion extending from the other of the both ends of the narrow portion, (iii) a first level difference portion provided at a boundary between the pin body and the narrow portion, and (iv) a second level difference portion provided at a boundary between the narrow portion and the end portion, the first position may be a position at which the contact section comes into contact with the first level difference portion, and the second position may be a position at which the contact section comes into contact with the second level difference portion.

The pin may consist of a single part.

The end portion may be a part separate from the narrow portion.

A method according to a second aspect of the present disclosure, which is a method for manufacturing the press-fit terminal according to the first aspect of the present disclosure, includes: preparing the pin made of a single material; preparing the contact section that is at least partially flattened from a state in which the contact section has a cylindrical shape; and winding the contact section around the narrow portion.

A method according to a third aspect of the present disclosure, which is a method for manufacturing the press-fit terminal according to the first aspect of the present disclosure, includes: preparing (i) a first pin formation member having the narrow portion and (ii) a second pin formation member different from the first pin formation member; preparing the cylindrical contact section; mounting the contact section on the narrow portion; and attaching the second pin formation member to the first pin formation member in order to make the pin.

The second pin formation member may be fixed to an end of the first pin formation member by crimping or welding.

Advantageous Effects of Invention

According to the present disclosure, in the case in which the contact section is located at the first position, the elastic contact piece does not come into contact with the large diameter portion, and thus the flexibility of the elastic contact piece is kept. In the case in which the contact section is located at the second position, the elastic contact piece abuts the large diameter portion, and thus the elastic contact piece does not easily bend. As a result, the present disclosure enables a reduction in insertion force necessary for attachment of the the press-fit terminal to an attachment portion of the press-fit attachment object without losing an ability to remain connected to the press-fit attachment object.

DESCRIPTION OF EMBODIMENTS

Embodiment 1

A press-fit terminal 1 according to Embodiment 1 of the present description is described below in detail with reference to the drawings. A XYZ coordinate system is used in order to facilitate understanding and reference to the XYZ coordinate system is made as necessary. A Z axis of the XYZ coordinate system is parallel to a central axis A1 of a pin 10 of the press-fit terminal 1. Also, components that are the same or equivalent are assigned the same reference signs throughout the drawings.

Figure 1:
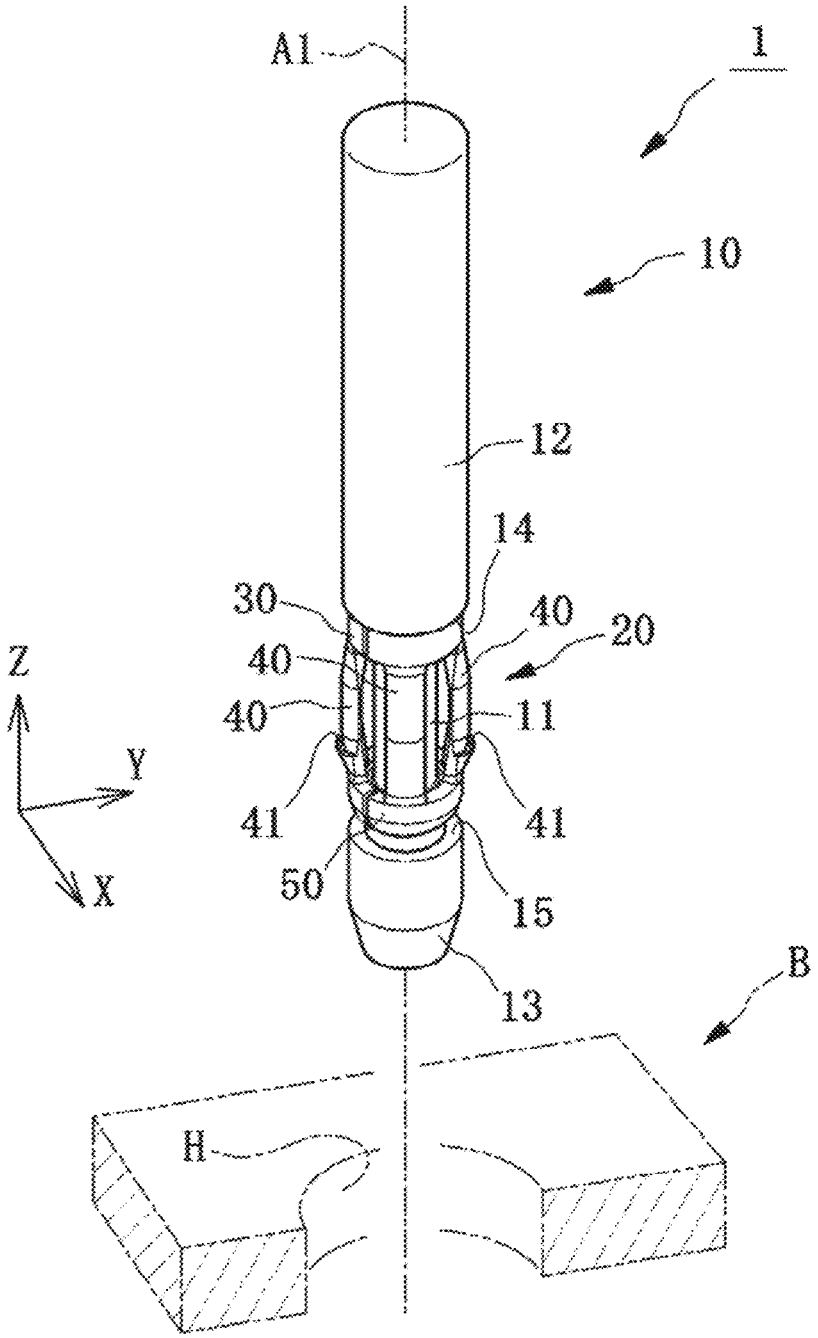
FIG. 1 is a perspective view of a press-fit terminal according to Embodiment 1 of the present disclosure.

The press-fit terminal 1 is a terminal for a vehicle-mounted device that is able to conduct high current of, for example, 60 to 80 A. For example, during the use of the press-fit terminal 1, the press-fit terminal 1 is electrically connected to a through hole H of a circuit board B that is the press-fit attachment object. As illustrated in FIG. 1, the press-fit terminal 1 includes the pin 10 and a contact section 20 having elasticity.

Figure 2:
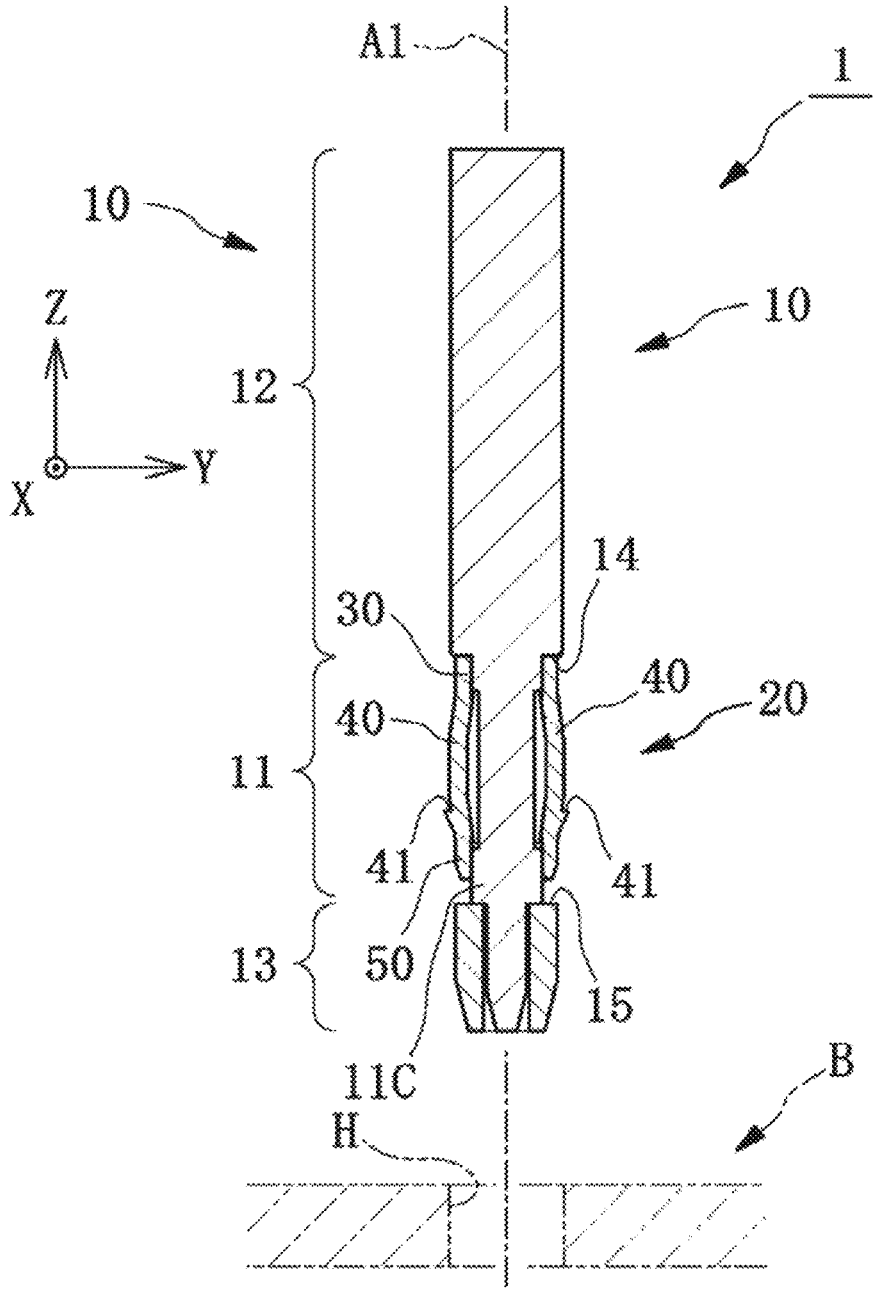
FIG. 2 is a cross sectional view of the press-fit terminal.
Figure 3:
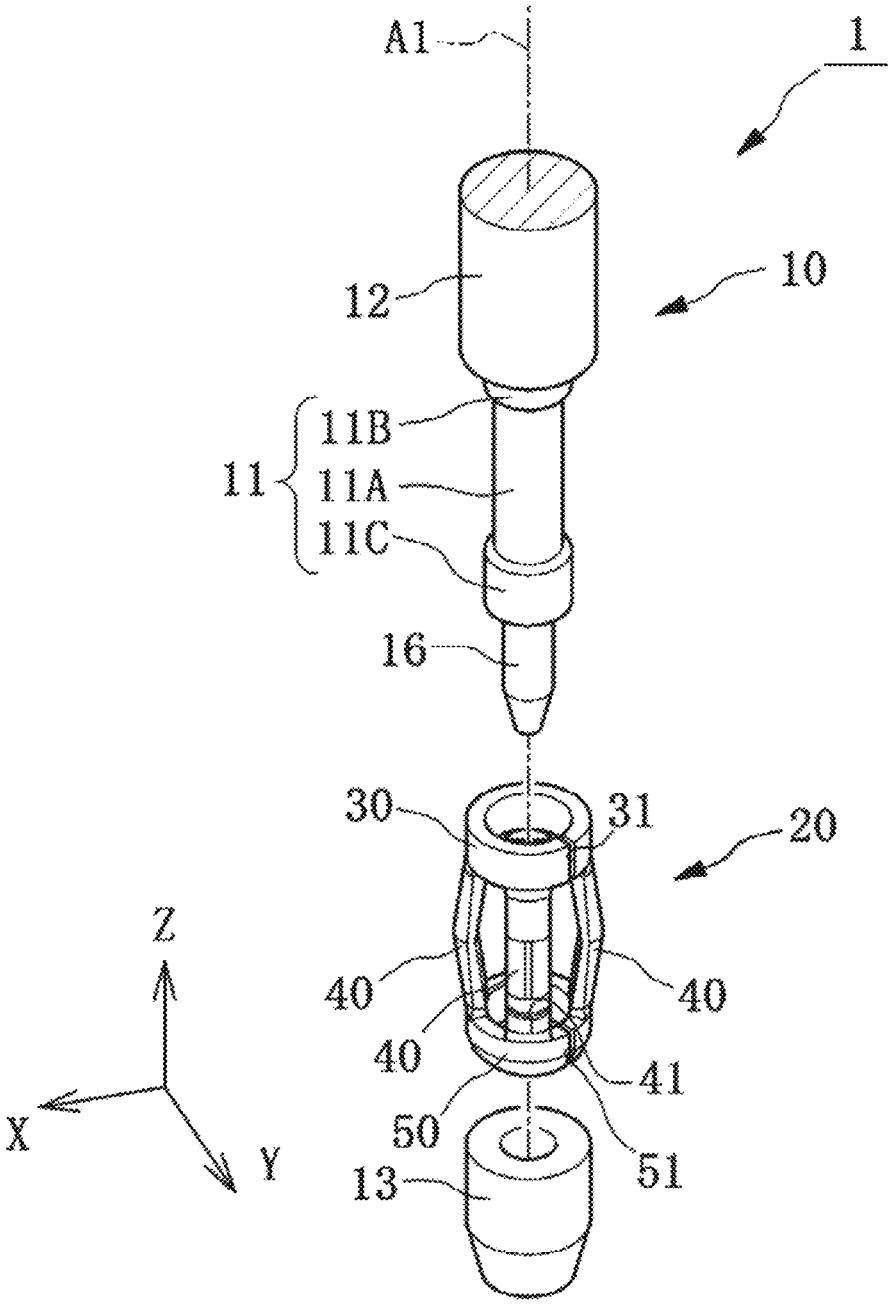
FIG. 3 is an exploded perspective view of the press-fit terminal.

As illustrated in FIGS. 2 and 3, the pin 10 is a cylindrical member having a narrow portion 11 and functions as, for example, an external connection terminal of a terminal module that is not illustrated in the drawings. The pin 10 has not only the narrow portion 11 but also a pin body 12, an end portion 13, a first level difference portion 14 and a second level difference portion 15.

Figure 4:
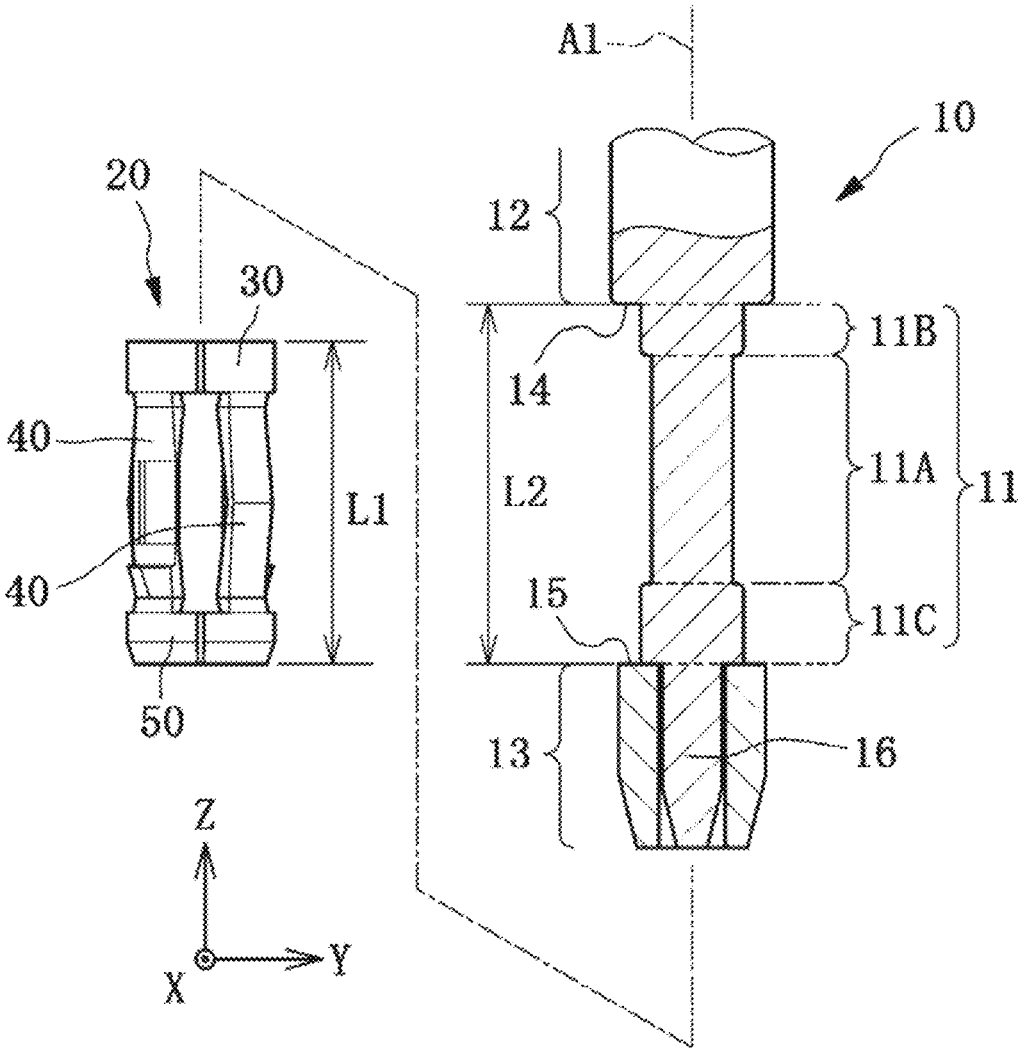
FIG. 4 is a cross sectional view of a pin.

As illustrated in FIG. 4, the narrow portion 11 is a portion on which the contact section 20 is mounted. The narrow portion 11 is formed to have an approximately cylindrical shape and to be long in the Z-axis direction. The narrow portion 11 has a small diameter portion 11A and large diameter portions 11B and 11C that are located at the both ends of the small diameter portion 11A. The large diameter portions 11B and 11C each have a diameter larger than a diameter of the small diameter portion 11A. The diameter portion 11 B located on the +Z-side has a diameter equal to the diameter of the diameter portion 11C located on the −Z-side. An attachment shaft portion 16 extends from an end of the narrow portion 11 in the −Z-direction.

The pin body 12 is formed to have a cylindrical shape and to have a diameter larger than the diameter of the narrow portion 11. For example, a metal wire bonding is performed in the vicinity of an upper end (the +Z-side end) of the pin body 12. The pin body 12, the narrow portion 11 and the attachment shaft portion 16 are formed integrally with one another by performing a machining process on a single piece of material, and thus the pin body 12, the narrow portion 11 and the attachment shaft portion 16 constitute one component.

The end portion 13 is a part separate from the pin body 12, the narrow portion 11 and the attachment shaft portion 16 in Embodiment 1. The end portion 13 is formed to have a cylindrical shape and to have a conical surface on the −Z-side end of the end portion 13. The end portion 13 is fitted into and fixed to the attachment shaft portion 16 by crimping or welding. The end portion 13 functions as a stopper for preventing the contact section 20 from being disconnected from the pin 10.

The first level difference portion 14 is formed on a boundary between the pin body 12 and the narrow portion 11, more specifically, on a boundary between the pin body 12 and the large diameter portion 11B of the narrow portion 11.

The second level difference portion 15 is formed on a boundary between the narrow portion 11 and the end portion 13, more specifically, on a boundary between the large diameter portion 11C of the narrow portion 11 and the end portion 13.

As illustrated in FIG. 4, the contact section 20 is a conductive part formed to have an approximately cylindrical shape. The contact section 20 is formed such that a length L1 of the contact section 20 in the Z-axis direction that is smaller than a length L2 of the narrow portion 11 in the Z-axis direction. As a result, the contact section 20 is mounted on the narrow portion 11 such that the contact section 20 is able to move relative to the pin 10 between the first position illustrated in FIG. 5 and the second position illustrated in FIG. 6. The first position is a position at which the upper end surface of the contact section 20 comes into contact with the first level difference portion 14. The second position is a position at which the lower end surface of the contact section 20 comes into contact with the second level difference portion 15. A distance over which the contact section 20 can move is a value obtained by subtracting the length L1 from the length L2, (L2−L1). Also, in the present disclosure, the meaning of the phrase, "the contact section is movably mounted on the narrow portion", includes a case in which the pin or the narrow portion moves relative to the contact section even though the contact section itself does not move.

As illustrated in FIG. 3, the contact section 20 has an upper-side connection portion 30, four elastic contact pieces 40 and a lower-side connection portion 50.

The upper-side connection portion 30 is connected to the upper ends (the +Z-side ends) of the elastic contact pieces 40 and thus supports the four elastic contact pieces 40. The upper-side connection portion 30 is formed to have a C-shaped cross section on the XY plane that is partially open. An opening portion of the C-shape of the upper-side connection portion 30 is formed as a slit 31 leading from the interior to the exterior. In Embodiment 1, the upper-side connection portion 30 has a single slit 31.

The upper-side connection portion 30 is formed to have an inner diameter approximately equal to or slightly larger than the outer diameter of the large diameter portion 11B of the narrow portion 11. As a result, the upper-side connection portion 30 is slidably disposed on the large diameter portion 11B.

The elastic contact pieces 40 are portions to come into contact with an inner side wall of the through hole H of the circuit board B that is the press-fit attachment object (refer to FIG. 1). The elastic contact pieces 40 are formed to protrude from the central axis A1 of the pin 10 outward. The elastic contact pieces 40 are disposed such that the elastic contact pieces bend inward when the press-fit terminal 1 is inserted into the through hole H.

Figure 7:
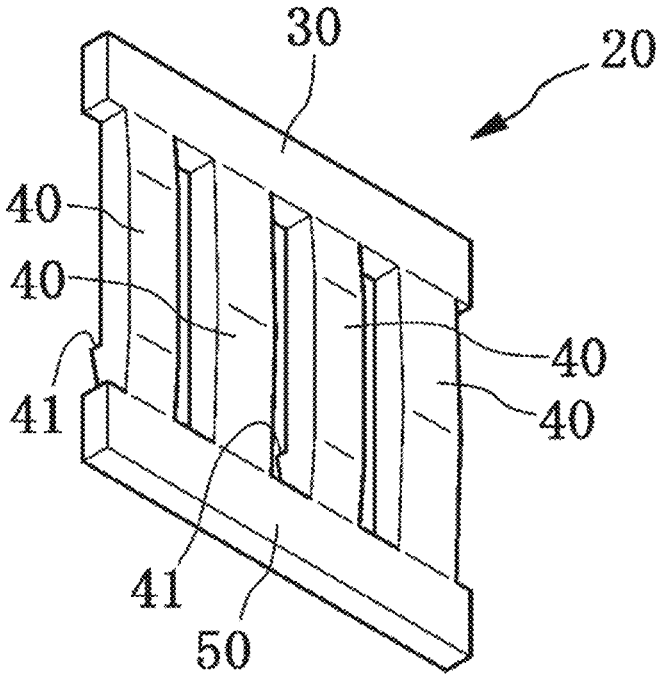
FIG. 7 is a perspective view illustrating the contact section that is flattened.

As illustrated in FIG. 7, two elastic contact pieces 40 among the four elastic contact pieces 40 have engagement portions 41. The engagement portions 41 remain connected to the circuit board B that is the press-fit attachment object.

As illustrated in FIG. 3, the lower-side connection portion 50 is connected to the lower ends (the −Z-side ends) of the elastic contact pieces 40, and thus the lower-side connection portion 50 together with the upper-side connection portion 30 supports the four elastic contact pieces 40. The lower-side connection portion 50 is formed to have a C-shaped cross section on the XY plane that is partially open. An opening portion of the C-shape of the lower-side connection portion 50 is formed as a slit 51 leading from the interior to the exterior. In Embodiment 1, the lower-side connection portion 50 has a single slit 51.

The lower-side connection portion 50 is formed to have an inner diameter approximately equal to or slightly larger than the outer diameter of the large diameter portion 11C of the narrow portion 11. As a result, the lower-side connection portion 50 is slidably disposed on the large diameter portion 11C.

Next, a method of attaching the press-fit terminal 1 to the press-fit attachment object is described with reference to the drawings. In Embodiment 1, the press-fit attachment object is the circuit board B and the attachment portion of the press-fit attachment object is the through hole H of the circuit board B.

Figure 8:
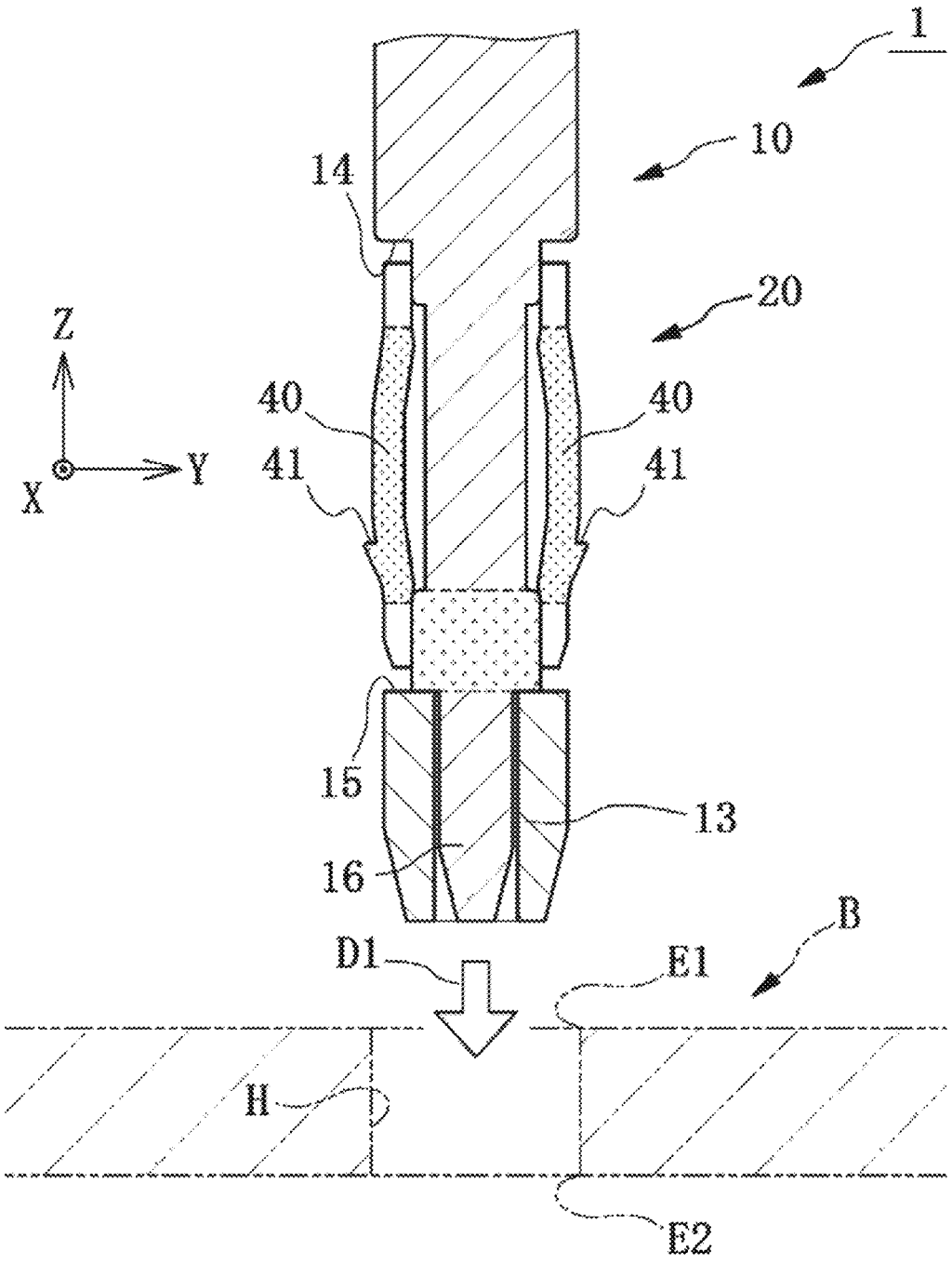
FIG. 8 is a cross sectional view for explaining how to attach the press-fit terminal into a through hole of a circuit board (Part 1)
Figure 9:
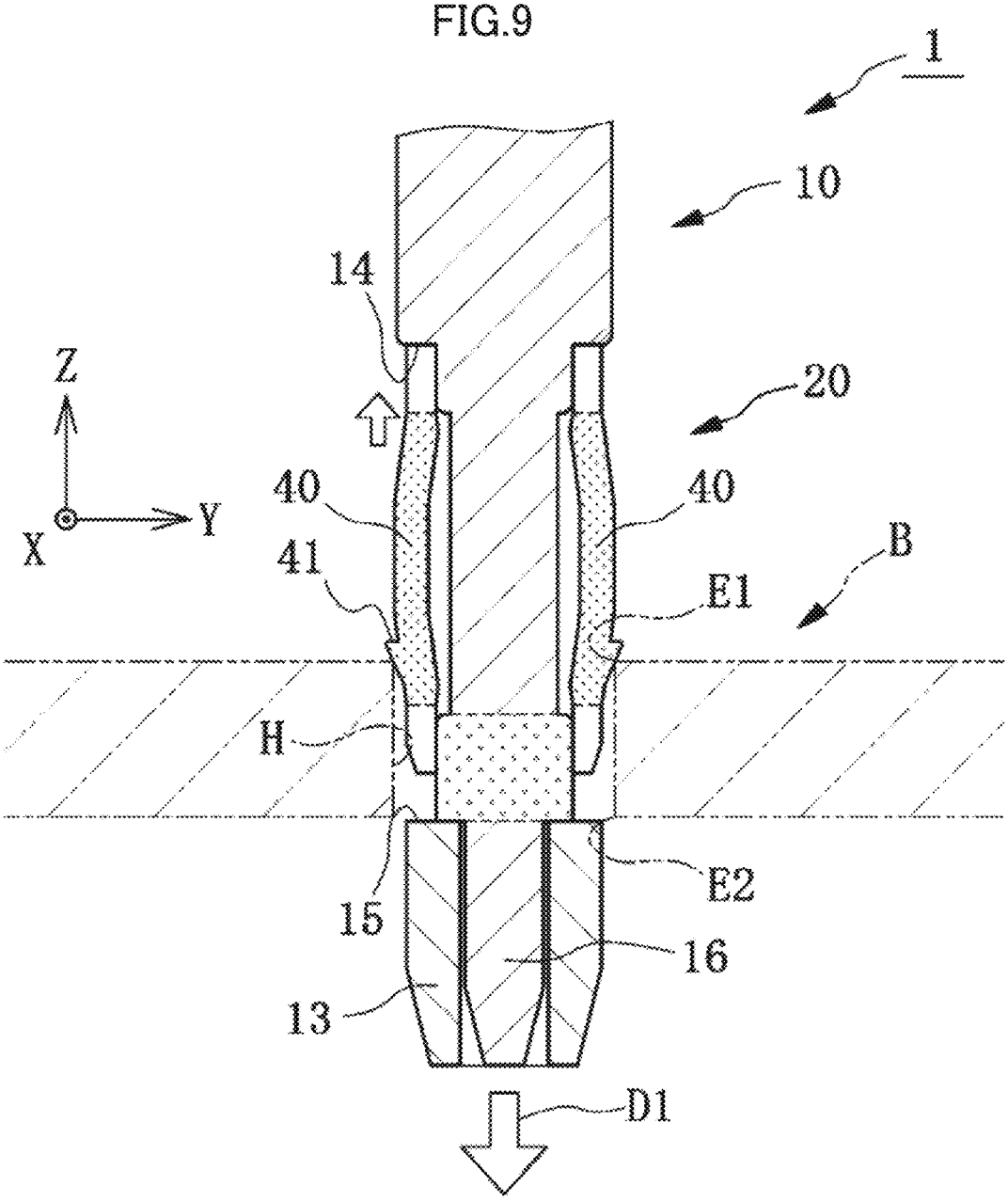
FIG. 9 is a cross sectional view for explaining how to attach the press-fit terminal into the through hole of the circuit board (Part 2)

As the movement of the press-fit terminal 1 in the insertion direction D1 proceeds as illustrated in FIG. 8, the contact section 20 is inserted into the through hole H as illustrated in FIG. 9, and the engagement portions 41 of the elastic contact pieces 40 come into contact with an upper edge portion E1 of an opening of the through hole H. At this point, the contact section 20 slides along the narrow portion 11 in the +Z direction and then moves to the first position at which the upper end surface of the contact section 20 comes into contact with the first level difference portion 14.

Figure 10:
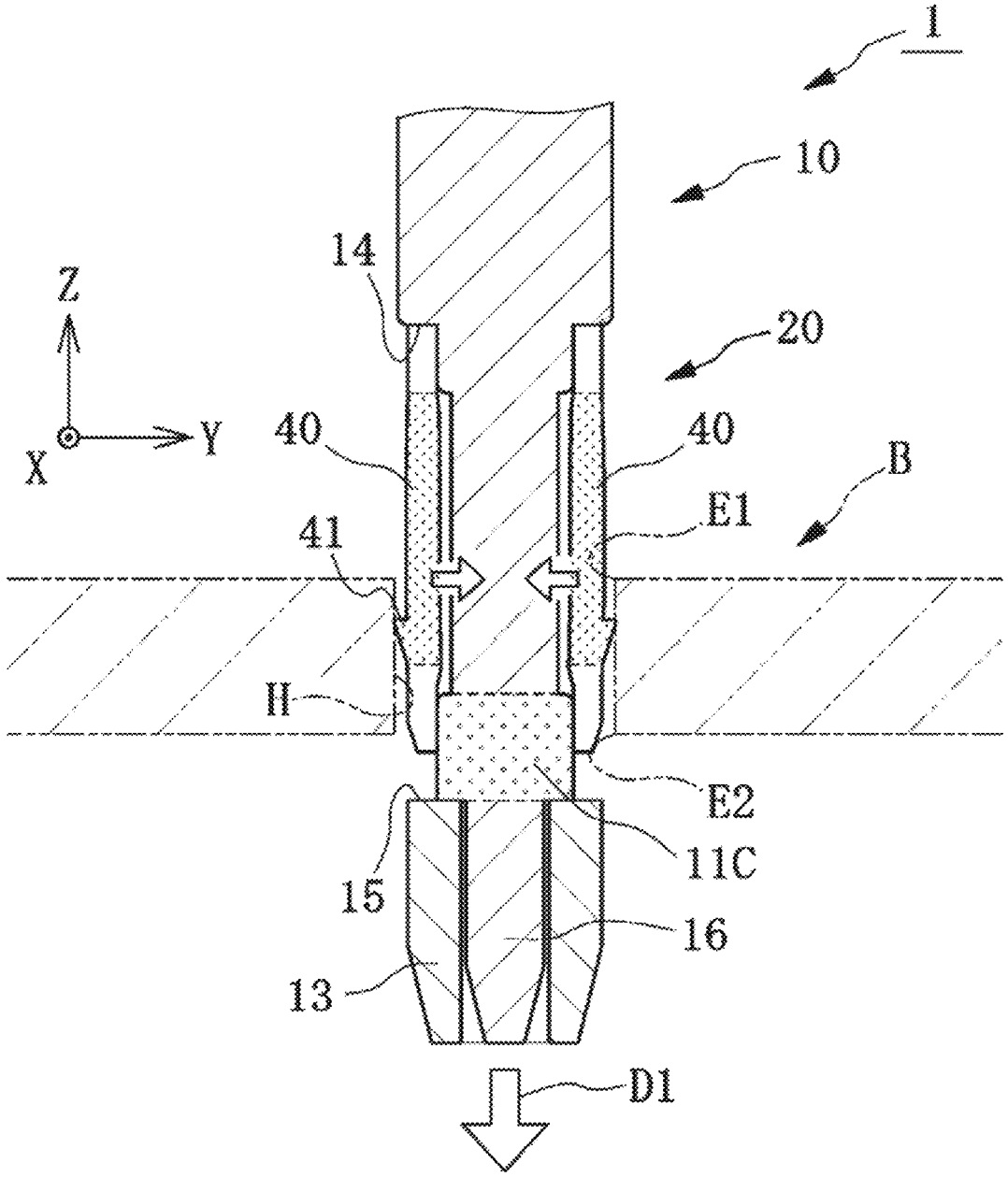
FIG. 10 is a cross sectional view for explaining how to attach the press-fit terminal into the through hole of the circuit board (Part 3)

As the insertion of the contact section 20 into the through hole H further proceeds, as illustrated in FIG. 10, the engagement portions 41 are guided to the upper edge E1 of the opening and the elastic contact pieces 40 bend inward. At this point in time, the contact section 20 is located at the first position, and thus the elastic contact pieces 40 of the contact section 20 do not come into contact with the large diameter portion 11C. As a result, the elastic contact pieces 40 can bend inward.

Figure 11:
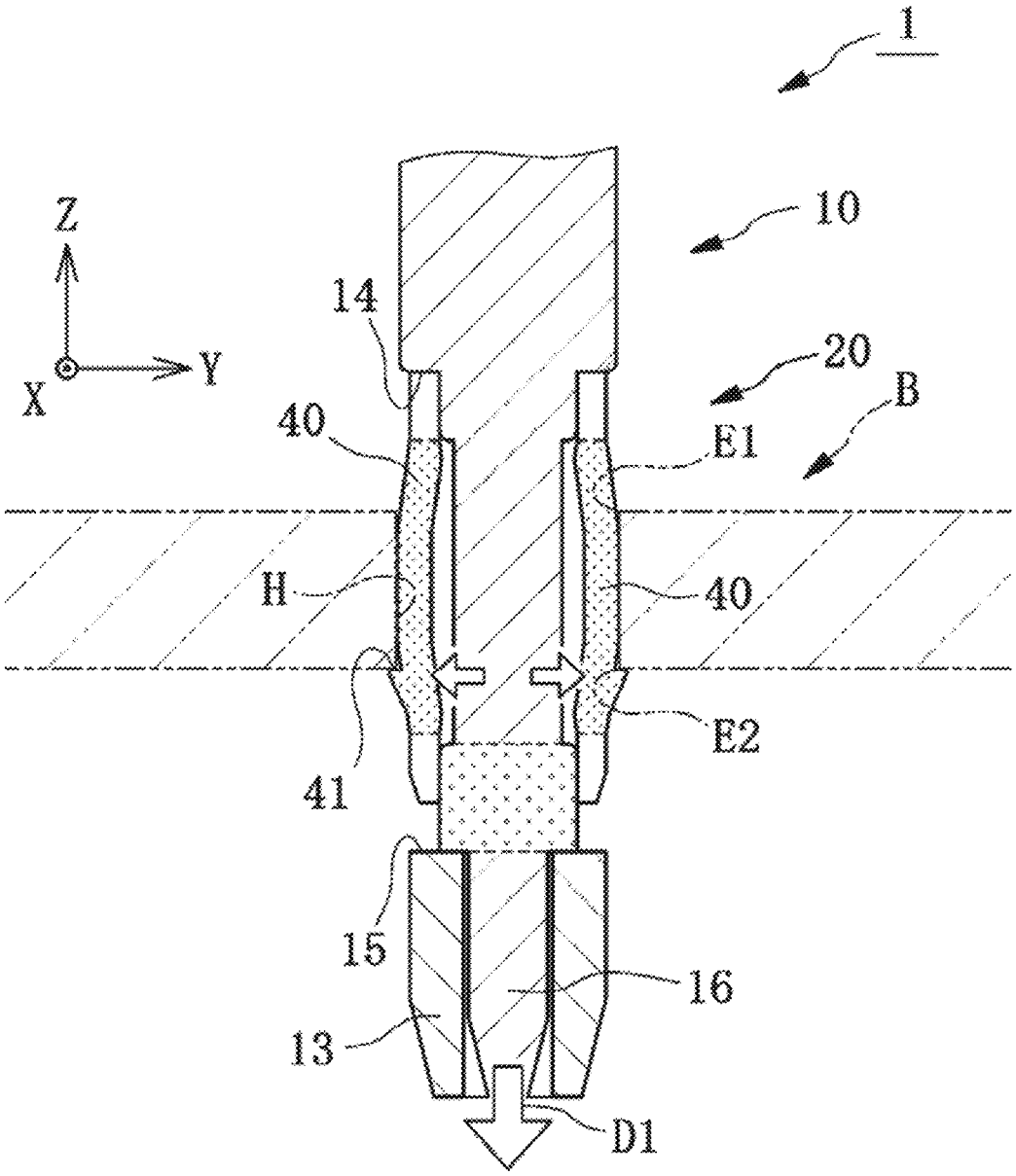
FIG. 11 is a cross sectional view for explaining how to attach the press-fit terminal into the through hole of the circuit board (Part 4)

As the insertion of the contact section 20 into the through hole H much further proceeds, the engagement portions 41 pass through the through hole H as illustrated in FIG. 11, the elastic contact pieces 40 recover the elasticity, and thus the engagement portions 41 engage with a lower edge E2 of the opening of the through hole H. As a result, the process of fitting the press-fit terminal 1 into the through hole H of the circuit board B is finished.

Figure 12:
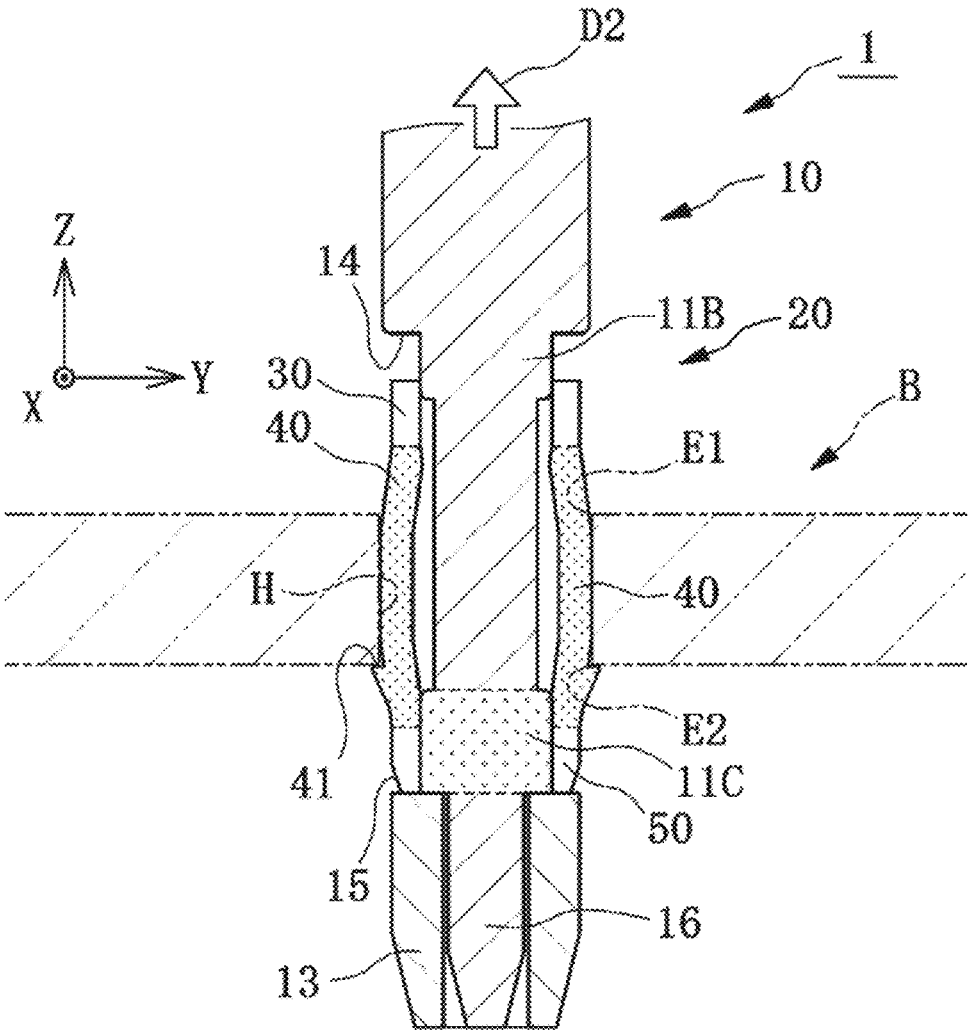
FIG. 12 is a cross sectional view for explaining an operation effect of the press-fit terminal.

Next, when a pull-out force in a withdrawal direction D2 is applied to the press-fit terminal 1 fitted into the through hole H of the circuit board B as illustrated in FIG. 12, the contact section 20 does not move relative to the circuit board B due to an effect of the engagement of the engagement portions 41, and the large diameter portion 11B and the upper-side connection portion 30 slide and the large diameter portion 11C and the lower-side connection portion 50 slide, thereby causing the pin 10 of the press-fit terminal 1 to move to the second position at which the lower end surface of the contact section 20 comes into contact with the second level difference portion 15. At this point in time, the elastic contact pieces 40 of the contact section 20 abut the large diameter portion 11C. As a result, the elastic contact pieces 40 cannot bend inward, and thus the engagement portions 41 are not easily disengaged from the lower edge E2 of the opening of the through hole H.

The press-fit terminal 1 configured as described above is made as follows.

Figure 13:
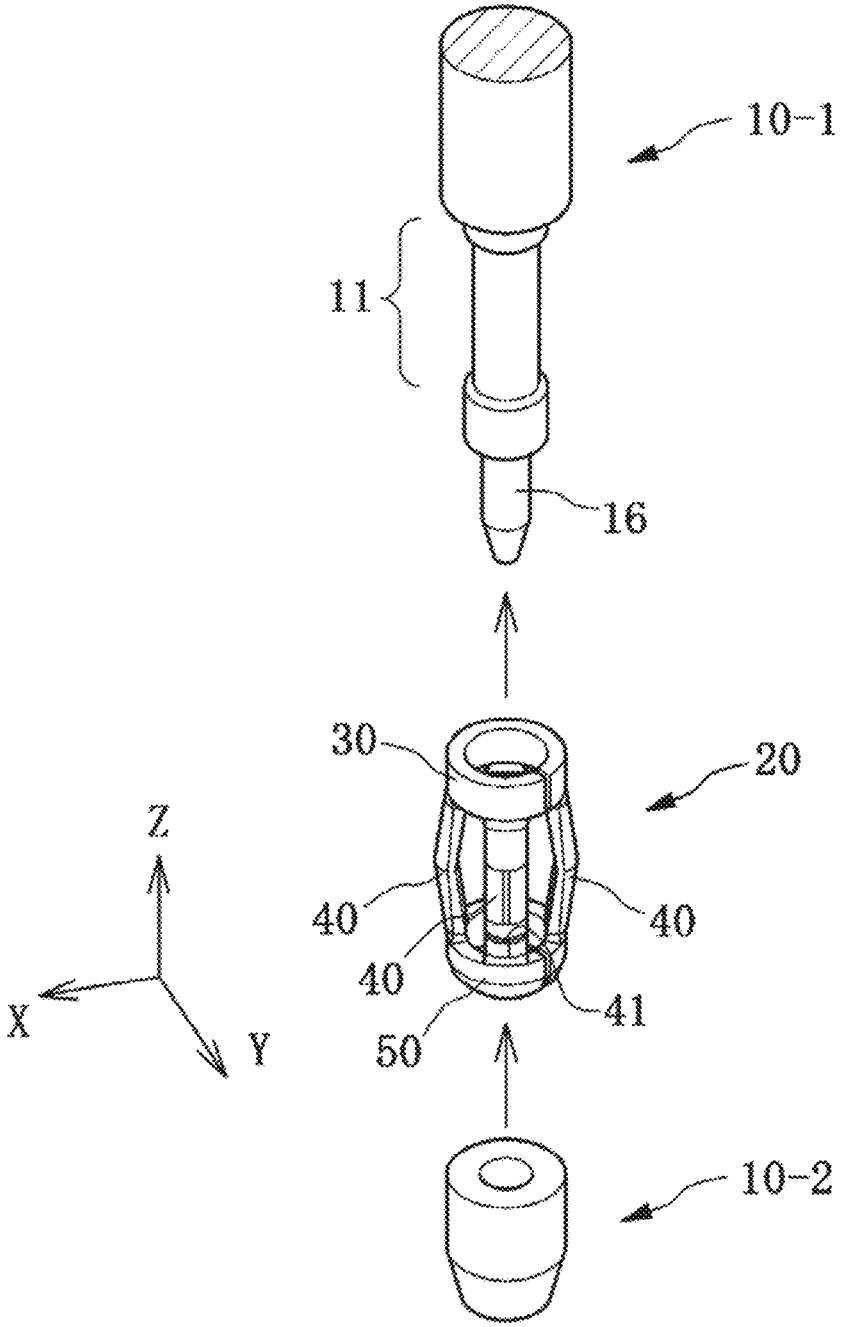
FIG. 13 is a perspective view for explaining a method of making the press-fit terminal.

As illustrated in FIG. 13, a first pin formation member 10-1 having the narrow portion 11 and a second pin formation member 10-2 different from the first pin formation member 10-1 are first prepared in a first step.

Subsequently, the cylindrical contact section 20 is prepared in a second step.

Subsequently, the contact section 20 is fitted to the narrow portion 11 of the first pin formation member 10-1 in a third step. The contact section 20 fitted to the narrow portion is arranged on the the narrow portion 11.

Subsequently, the second pin formation member 10-2 is attached to the attachment shaft portion 16 of the end of the first pin formation member 10-1 in a fourth step to make the pin 10 illustrated in FIG. 4. The second pin formation member 10-2 is fixed to the attachment shaft portion 16 of the first pin formation member 10-1 by crimping or welding. However, a method of fixing the second pin formation member 10-2 in the present disclosure is not limited to crimping or welding. The second pin formation member 10-2 may be fixed to the attachment shaft portion 16 of the first pin formation member 10-1 by a method other than crimping and welding. By the method described above, the press-fit terminal 1 is completed.

Figure 5:
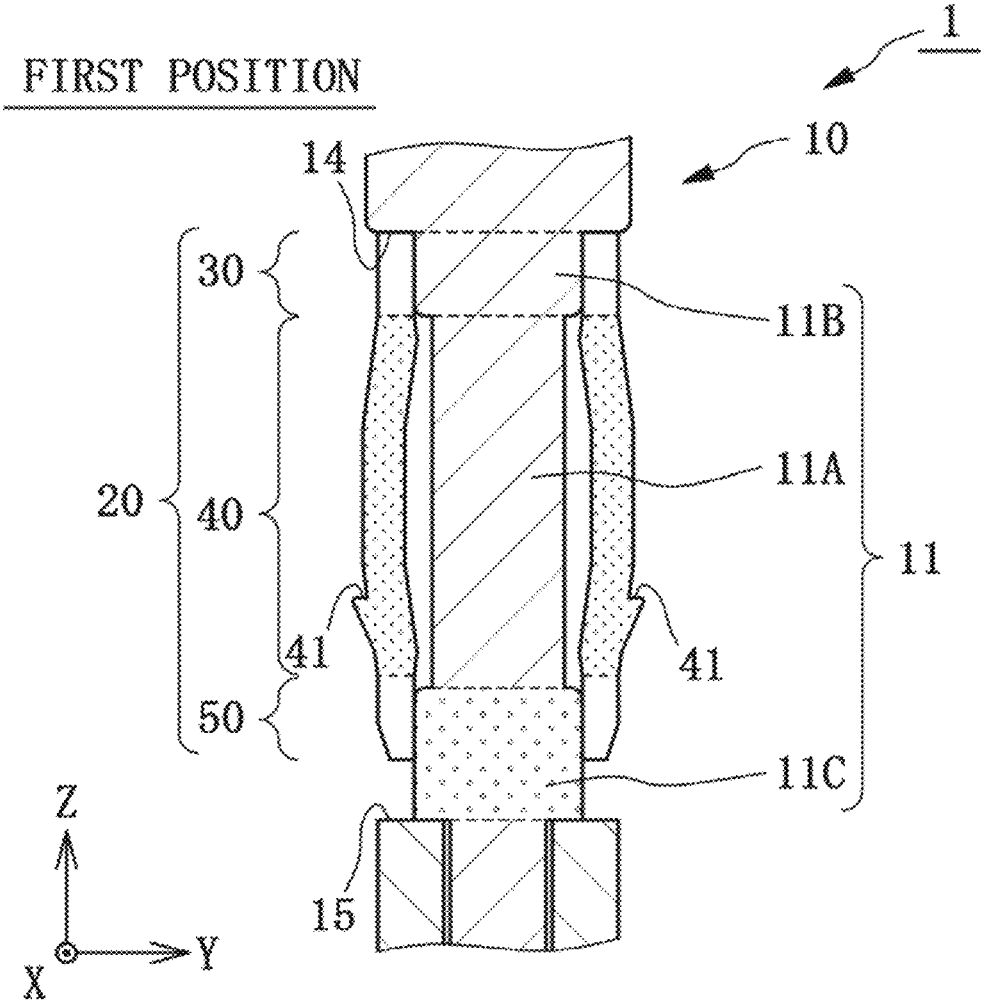
FIG. 5 is a cross sectional view illustrating the pin and the contact section that is located at the first position.
Figure 6:
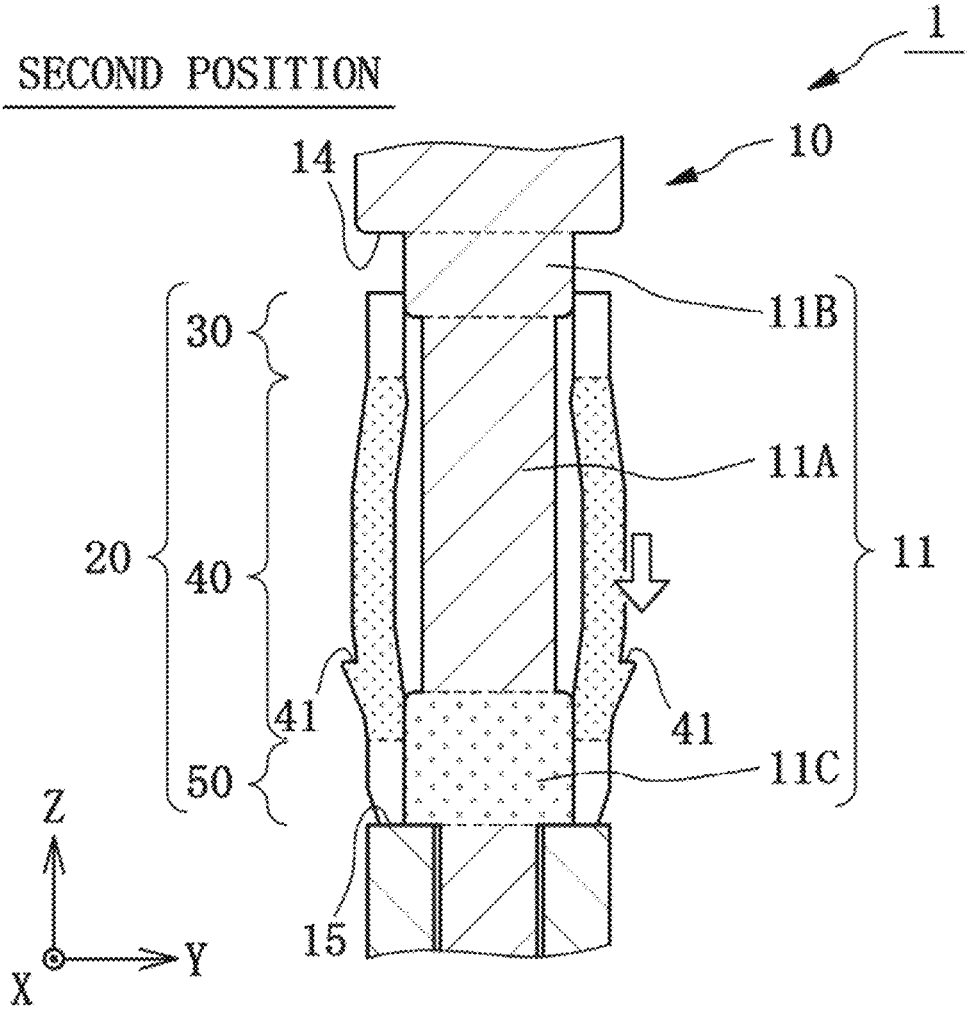
FIG. 6 is a cross sectional view illustrating the pin and the contact section that is located at the second position.

As described above, in Embodiment 1, in the case in which the contact section 20 is located at the first position, the elastic contact pieces 40 do not come into contact with the large diameter portion 11C as illustrated in FIGS. 5 and 6. As a result, the flexibility of the elastic contact pieces 40 can be kept. Additionally, in the case in which the contact section 20 is located at the second position, the elastic contact pieces 40 come into contact with the large diameter portion 11C and thus the elastic contact pieces 40 do not easily bend. As a result, the structure of Embodiment 1 enables a reduction in the insertion force during insertion of the press-fit terminal 1 into the through hole H of the circuit board B without losing the ability of the press-fit terminal 1 to remain connected to the circuit board B.

In Embodiment 1, the insertion force during the insertion of the press-fit terminal 1 into the through hole H of the circuit board B can be reduced, thereby enabling a reduction in damage to the circuit board B that is the press-fit attachment object. Eventually, occurrence of measling or strain in the circuit board B can be suppressed although the attachment of the press-fit terminal 1 may be accompanied by the occurrence of measling or strain. Additionally, the efficiency in the attachment of the press-fit terminal to the circuit board B can be improved.

Also, in Embodiment 1, although frictional force by the through hole H of the circuit board B is applied to the contact section 20 during a withdrawal of the press-fit terminal and thus the contact section 20 does not move relative to the circuit board B, the press-fit terminal 1 is not easily disengaged from the circuit board B due to the friction force between the contact section and the through hole H and the effect of engagement of the engagement portions 41. Additionally, since the contact section 20 is located at the second position during the withdrawal of the press-fit terminal, a spring portion of each of the elastic contact pieces 40 (that is a portion able to substantially bend) shortens due to the contact between the elastic contact pieces 40 and the large diameter portion 11B of the narrow portion 11, and thus the press-fit terminal 1 is not easily disengaged from the circuit board B.

The elastic contact pieces 40 have the engagement portions 41 to engage with the circuit board B. The engagement of the engagement portions 41 with the lower edge E2 of the opening of the through hole H enables an improvement of the ability of the press-fit terminal 1 to remain connected to the circuit board B.

Embodiment 2

A press-fit terminal 2 according to Embodiment 2 of the present disclosure is described below with reference to FIGS. 14 and 15. Also, in order to facilitate understanding, components that are the same as those in Embodiment 1 are assigned the same reference signs throughout the drawings, description of such components is omitted, and features of Embodiment 2 different from those of Embodiment 1 are mainly described.

Figure 14:
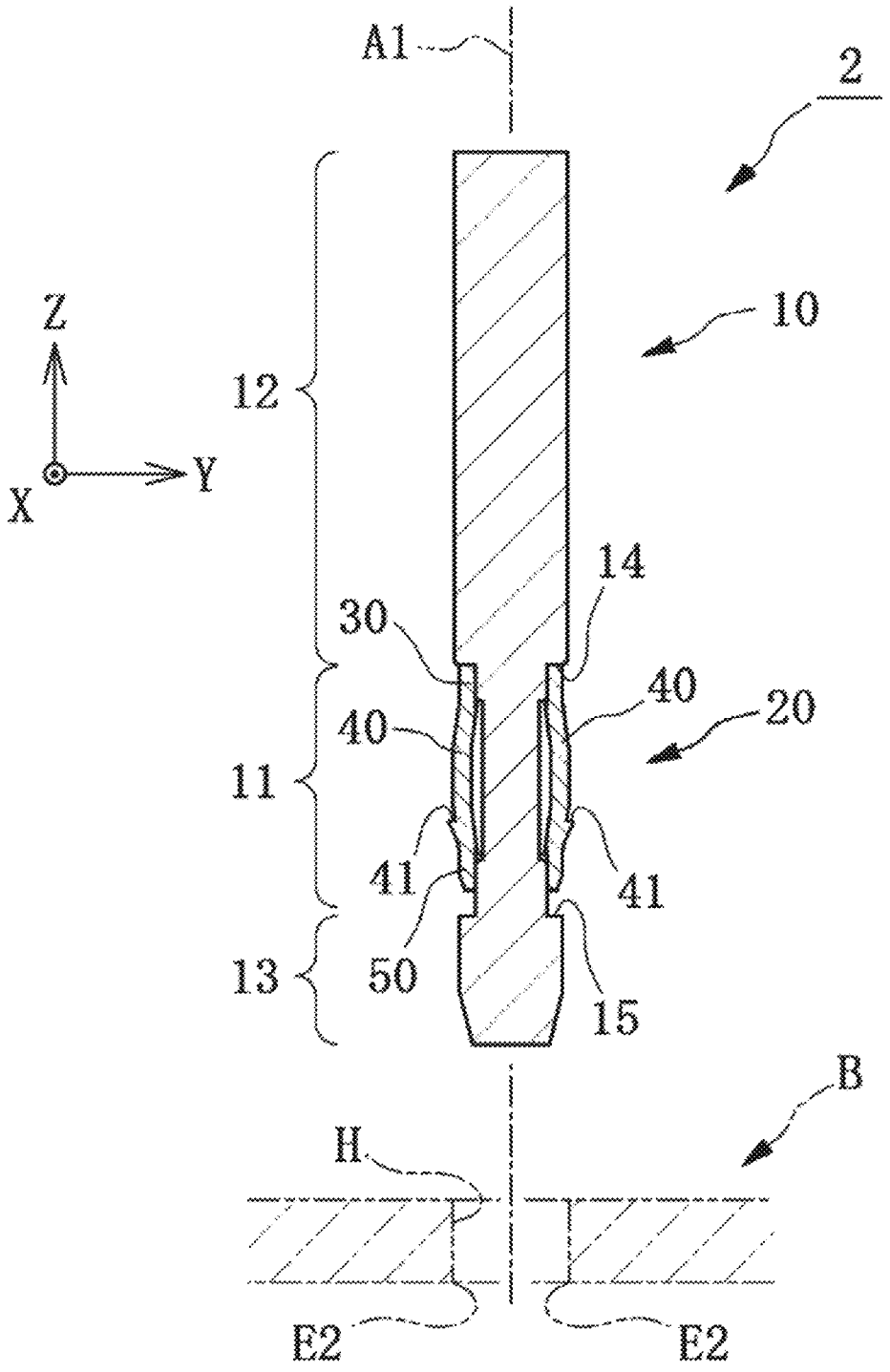
FIG. 14 is a cross sectional view of a press-fit terminal according to Embodiment 2 of the present disclosure.

As illustrated in FIG. 14, the press-fit terminal 2 includes a pin 10 and a contact section 20 having elasticity. The pin 10 has not only a narrow portion 11 but also a pin body 12, a end portion 13, a first level difference portion 14, and a second level difference portion 15. Unlike the pin 10 of Embodiment 1, the narrow portion 11, the pin body 12 and the end portion 13 of the pin 10 of Embodiment 2 are formed integrally with one another to constitute a single component.

The press-fit terminal 2 configured as described above is made as follows.

Figure 15:
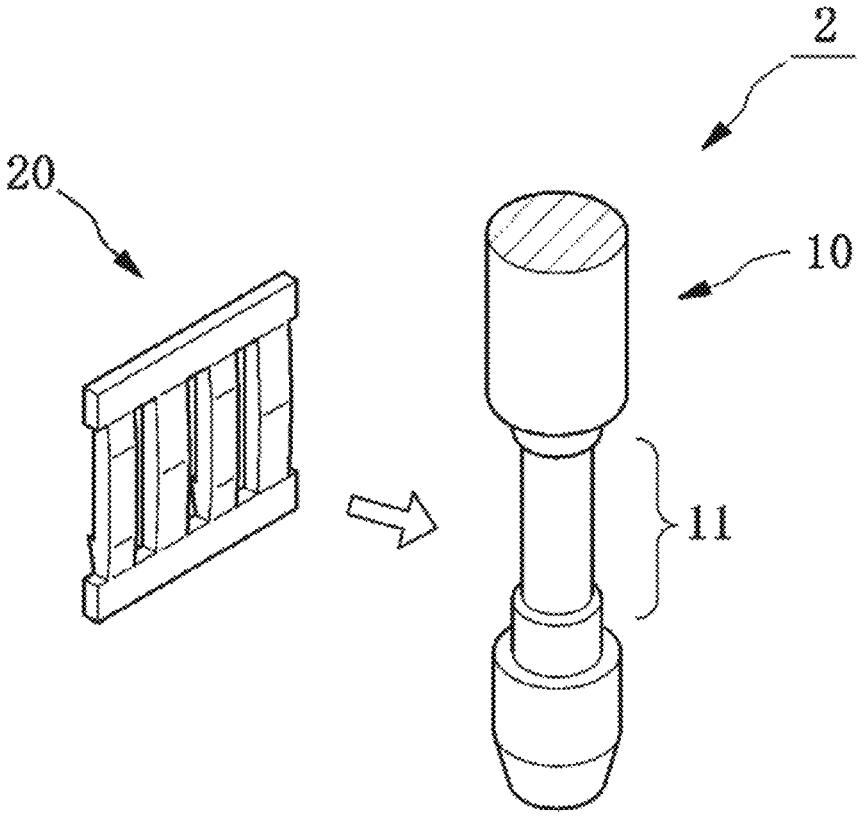
FIG. 15 is a perspective view for explaining a method of making the press-fit terminal according to Embodiment 2.

As illustrated in FIG. 15, the pin 10 made of single material is first prepared in a first step.

Subsequently, the contact section 20 is prepared in a second step and is flattened from a state in which the contact section has a cylindrical shape. There is no need to fully straight the contact section 20 prepared in the second step into the shape of a flat plate.

Subsequently, the straitened contact section 20 is wound around the narrow portion 11 of the pin 10 in a third step and the contact section 20 is shaped into a cylinder.

By the method described above, the press-fit terminal 2 is completed.

Figure 16:
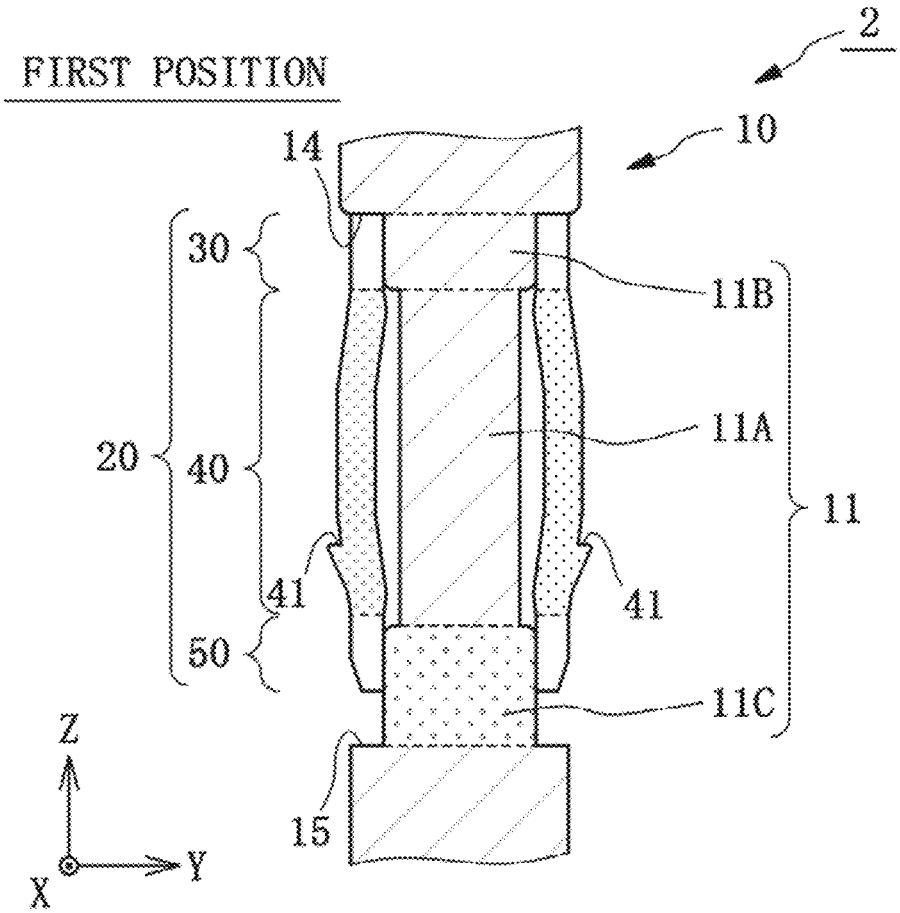
FIG. 16 is a cross sectional view illustrating the pin and the contact section that is located at the first position in Embodiment 2.
Figure 17:
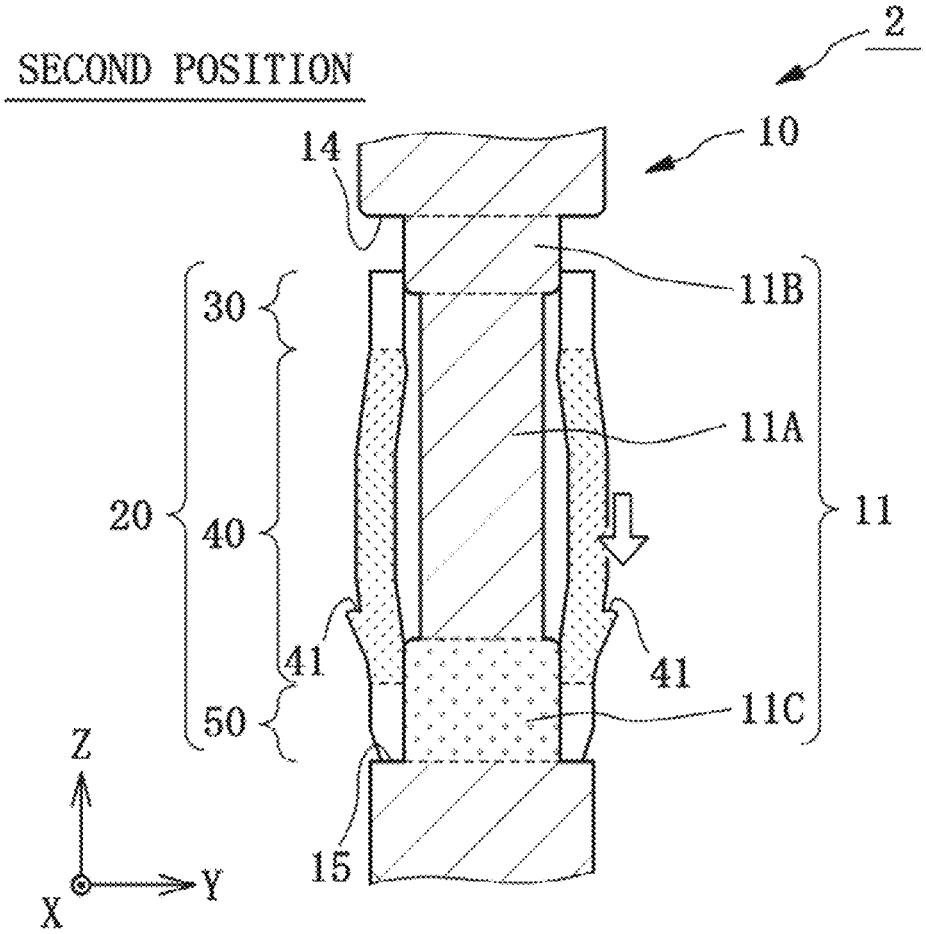
FIG. 17 is a cross sectional view illustrating the pin and the contact section that is located at the second position in Embodiment 2.

As described above, also in Embodiment 2 as in Embodiment 1, in the case in which the contact section 20 is located at the first position (FIG. 16), the elastic contact pieces 40 do not come into contact with the large diameter portion 11C. As a result, the flexibility of the elastic contact pieces 40 can be kept. Additionally, in the case in which the contact section 20 is located at the second position (FIG. 17), the elastic contact pieces 40 abut the large diameter portion 11C and thus the elastic contact pieces 40 do not easily bend. As a result, the structure of Embodiment 2 enables a reduction in the insertion force during insertion of the press-fit terminal 2 into the through hole H of the circuit board B without losing the ability of the press-fit terminal 2 to remain connected to the circuit board B illustrated in FIG. 14.

In Embodiment 2, the insertion force during the insertion of the press-fit terminal 2 into the through hole H of the circuit board B can be reduced, thereby enabling a reduction in damage to the circuit board B that is the press-fit attachment object. Eventually, occurrence of measling or strain in the circuit board B can be suppressed although the attachment of the press-fit terminal 2 may be accompanied by the occurrence of measling or strain. Additionally, the efficiency in the attachment of the press-fit terminal to the circuit board B can be improved.

Also, in Embodiment 2, although frictional force by the through hole H of the circuit board B is applied to the contact section 20 during a withdrawal of the press-fit terminal and thus the contact section 20 does not move relative to the circuit board B, the press-fit terminal 2 is not easily disengaged from the circuit board B due to the friction force between the contact section and the through hole H and the effect of engagement of the engagement portions 41. Additionally, since the contact section 20 is located at the second position during the withdrawal of the press-fit terminal, a spring portion of each of the elastic contact pieces 40 (that is a portion able to substantially bend) shortens due to the contact between the elastic contact pieces 40 and the large diameter portion 11C of the narrow portion 11, and thus the press-fit terminal 2 is not easily disengaged from the circuit board B.

The elastic contact pieces 40 have the engagement portions 41 to engage with the circuit board B. The engagement of the engagement portions 41 with the lower edge E2 of the opening of the through hole H enables an improvement of the ability of the press-fit terminal 2 to remain connected to the circuit board B.

Embodiments of the present disclosure are described above. The present disclosure is not limited to these embodiments.

For example, in Embodiments 1 and 2 of the present disclosure, the two elastic contact pieces 40 among the four elastic contact pieces 40 have the engagement portions 41. However, the present disclosure is not limited to such a structural feature. Each of the elastic contact pieces 40 may have the engagement portion 41. Alternatively, not all the four elastic contact pieces 41 are required to have the engagement portion 41. However, at least one of the elastic contact pieces 40 preferably has the engagement portion 41 from the viewpoint of the abilities of the press-fit terminals 1 and 2 to remain connected to the circuit board B. Also, each of two elastic contact pieces opposite to each other preferably has the engagement portion 41 from the viewpoint of the stability of the abilities of the press-fit terminals 1 and 2 to remain connected to the circuit board B.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

This application claims the benefit of Japanese Patent Application No. 2017-111244, filed on Jun. 6, 2017, the entire disclosure of which is incorporated by reference herein.

INDUSTRIAL APPLICABILITY

The press-fit terminals according to the present disclosure are suitable to use as a terminal for devices mounted on vehicles.

REFERENCE SIGNS LIST

1, 2 Press-fit terminal
10 Pin
10-1 First pin formation member
10-2 Second pin formation member
11 Narrow portion
11A Small diameter portion
11B, 11C Large diameter portion
12 Pin body
13 End portion
14 First level difference portion
15 Second level difference portion
16 Attachment shaft portion
20 Contact section
30 Upper-side connection portion
31, 51 Slit
40 Elastic contact piece
41 Engagement portion
50 Lower-side connection portion
A1 Central axis
B Circuit board (press-fit attachment object)
H Through hole (attachment portion of the press-fit attachment object)
E1 Upper edge
E2 Lower edge
D1 Insertion direction
D2 Withdrawal direction

The invention claimed is:

1. A press-fit terminal comprising:

a cylindrical pin having a narrow portion, the narrow portion having a narrow-portion main body and a large diameter portion that has a diameter larger than a diameter of the narrow-portion main body and is located at an end of the narrow-portion main body in an attachment direction in which the press-fit terminal is attached to a press-fit attachment object; and a contact section comprising a plurality of elastic contact pieces to come into contact with the press-fit attachment object and a connection portion that connects ends of the plurality of elastic contact pieces near the large diameter portion and is slidably disposed on the large diameter portion, the contact section being fitted to the narrow portion in a way that enables the contact section to move between a first position and a second position, the first position being a position at which the plurality of elastic contact pieces do not come into contact with the large diameter portion during attachment to the press-fit attachment object, the second position being a position at which the plurality of elastic contact pieces come into contact with a peripheral surface of the large diameter portion during a withdrawal from the press-fit attachment object while surrounding the larger diameter portion along a periphery thereof.

2. The press-fit terminal according to claim 1, wherein at least one of the plurality of elastic contact pieces has an engagement portion to engage with the press-fit attachment object.

3. The press-fit terminal according to claim 1, wherein the pin has:

a pin body extending from one of both ends of the narrow portion;

an end portion extending from the other of the both ends of the narrow portion;

a first level difference portion provided at a boundary between the pin body and the narrow portion; and a second level difference portion provided at a boundary between the narrow portion and the end portion, the first position is a position at which the contact section comes into contact with the first level difference portion, and the second position is a position at which the contact section comes into contact with the second level difference portion.

4. The press-fit terminal according to claim 3, wherein the pin consists of a single part.

5. The press-fit terminal according to claim 3, wherein the end portion is a part separate from the narrow portion.

6. A method for manufacturing the press-fit terminal according to claim 1, the method comprising:

preparing the pin made of a single material;

preparing the contact section that is at least partially flattened from a state in which the contact section has a cylindrical shape; and winding the contact section around the narrow portion.

7. A method for manufacturing a press-fit terminal, the press-fit terminal including (i) a cylindrical pin having a narrow portion and a large diameter portion that has a diameter larger than a diameter of the narrow portion and (ii) a contact section including an elastic contact piece to come into contact with a press-fit attachment object, the contact section being fitted to the narrow portion in a way that enables the contact section to move between a first position and a second position, the first position being a position at which the elastic contact piece does not come into contact with the large diameter portion during attachment to the press-fit attachment object, the second position being a position at which the elastic contact piece comes into contact with the large diameter portion during a withdrawal from the press-fit attachment object, the method comprising:

preparing (i) a first pin formation member having the narrow portion and (ii) a second pin formation member different from the first pin formation member;

preparing the cylindrical contact section;

mounting the contact section on the narrow portion; and attaching the second pin formation member to the first pin formation member in order to make the pin.

8. The method according to claim 7, wherein the second pin formation member is fixed to an end of the first pin formation member by crimping or welding.

* * * * *